United States Patent [19]

Wikström

[11] Patent Number: 4,869,639

[45] Date of Patent: Sep. 26, 1989

[54] METHOD AT VEHICLES HAVING A LIFTING DEVICE FOR COMPENSATING DEPARTURES IN THE POSITION OF LOADS ON THE LIFTING DEVICE RELATIVE TO THE FRAME OF THE VEHICLE

[76] Inventor: B. W. Sigvard Wikström, Videstigen 4, S-93143 Skelleftea, Sweden

[21] Appl. No.: 192,663

[22] Filed: May 11, 1988

Related U.S. Application Data

[63] Continuation of Ser. No. 918,316, Oct. 14, 1986, abandoned.

[30] Foreign Application Priority Data

Oct. 15, 1985 [SE] Sweden ..... 8504776

[51] Int. Cl.[4] ..... B66F 9/06

[52] U.S. Cl. ..... 414/786; 180/282; 187/9 R; 212/153; 280/755; 414/21; 414/273; 414/631

[58] Field of Search ..... 414/786, 273, 277, 663, 414/280–283, 628–632, 785, 21, 698, 699, 674, 700; 212/153–155; 280/755; 187/9 R, 9 E, 32; 180/282

[56] References Cited

U.S. PATENT DOCUMENTS

| | | | |
|---|---|---|---|
| 3,059,710 | 10/1962 | Pien | 414/21 X |
| 3,063,576 | 11/1962 | Hofmeister | 414/21 |
| 3,672,470 | 6/1972 | Ohntrup et al. | 187/9 R X |
| 3,695,463 | 10/1972 | Weisker et al. | 414/281 X |
| 3,719,295 | 3/1973 | Grace | 414/635 |
| 3,746,112 | 7/1973 | Ilon | 180/6.2 |
| 4,003,487 | 1/1977 | Downing | 414/629 |
| 4,122,957 | 10/1978 | Allen et al. | 414/281 |
| 4,278,142 | 7/1981 | Kono | 180/168 |
| 4,307,791 | 12/1981 | De Bruine | 180/168 |
| 4,309,758 | 1/1982 | Halsall et al. | 364/424.02 |
| 4,344,498 | 8/1982 | Lindfors | 180/168 |
| 4,345,662 | 8/1982 | Deplante | 180/168 |
| 4,411,577 | 10/1983 | Shearer, Jr. | 414/273 X |
| 4,499,541 | 2/1985 | Yuki et al. | 414/273 X |
| 4,530,057 | 7/1985 | Ahlbom | 364/424.02 |
| 4,556,940 | 12/1985 | Katoo et al. | 364/424.02 |
| 4,566,032 | 1/1986 | Hirooka et al. | 358/103 |
| 4,593,238 | 6/1986 | Yamamoto | 318/587 |

FOREIGN PATENT DOCUMENTS

| | | |
|---|---|---|
| 2308450 | 8/1978 | Fed. Rep. of Germany . |
| 423839 | 6/1982 | Sweden . |
| 423840 | 6/1982 | Sweden . |
| 979483 | 1/1965 | United Kingdom . |
| 2143969 | 2/1985 | United Kingdom . |

*Primary Examiner*—David A. Bucci

*Attorney, Agent, or Firm*—Foley & Lardner, Schwartz, Jeffery, Schwaab, Mack, Blumenthal & Evans

[57] ABSTRACT

The present invention relates to a compensating method applicable to vehicles having a lifting device made up of a mast (4) and vertically adjustable load carrier (5) provided on the mast. The method is for compensating departures in the position of loads (8, 9), preferably goods on loading stools or pallets, on the load carrier (5) relative to a frame (2) of a wheel driver vehicle (1). Loads (8, 9) of different weight when lifted to various heights deflect the mast (4) outwards in various degrees from an unloaded position. The vehicle (1) is adapted to repeatedly deliver loads (8, 9) on the load carrier (5) at different levels (12, 13, 14) in a storage system (11) and in predetermined delivering positions (P3) on each such level (12, 13, 14). A drive-up length ($L_o$) corresponding to moving the vehicle (1) without a load (8, 9) from a reference point (R2) to a delivering position (P2) has been determined. In order to provide quick and safe compensation of deflections, the invention determines the size (Δ1) of the outward deflection of the mast (4) is and the vehicle (1) is operated to move from the reference point (R2) towards the delivering position (P2) by length ($L_{last}$) corresponding to the determined drive-up length ($L_o$) reduced by a partial length (Δ1) which depends on the outward deflection of the mast (4).

6 Claims, 2 Drawing Sheets

METHOD AT VEHICLES HAVING A LIFTING DEVICE FOR COMPENSATING DEPARTURES IN THE POSITION OF LOADS ON THE LIFTING DEVICE RELATIVE TO THE FRAME OF THE VEHICLE

This application is a continuation of application Ser. No. 918,316, filed Oct. 14, 1986, now abandoned.

The present invention relates to a method for vehicles having a lifting device with a mast and vertically adjustable load carrying means provided on the mast for compensating departures in the position of loads, preferably goods on loading stools or pallets, on the load carrier relative to a frame of the vehicle provided with driving wheels occurring while loads of different weight and lifted to various heights deflect the mast outwards in various degrees from an unloaded position, whereby the vehicle is adapted to repeatedly deliver loads on the load carrier at different levels in a storage system and in predetermined delivering positions on each such level and whereby a drive-up length corresponding to moving the vehicle without a load from a reference point to a delivering position has been determined.

At drive-up of the vehicle described above from the reference point towards the delivering position, it has been noticed that the load can end up beside the delivering position although the frame of the vehicle has been moved the exact drive-up length or distance. This is because light loads take another position than heavy loads relative to the frame and that more elevated loads take another position relative to said frame than less elevated loads. The result therefor is that the mast is deflected outwards in various degrees relative to the frame and the extent of this deflection depends on the weight of the load and the elevation thereof above the frame.

This deflection may vary within wide limits and the load can end up so far from the correct delivering position that it can not be fetched by the vehicle, which would cause a direct interruption of the handling of loads.

The object of the present invention has been to eliminate this problem and provide a method which guarantees that the load always ends up in correct delivering position irrespective of the deflection of the mast. This is arrived at according to the invention by determining the outward deflection of the mast and operating the vehicle from a reference point towards a delivery position by an amount determined by the drive up length reduced by a length which depends on outward mast deflection.

Figure 1:
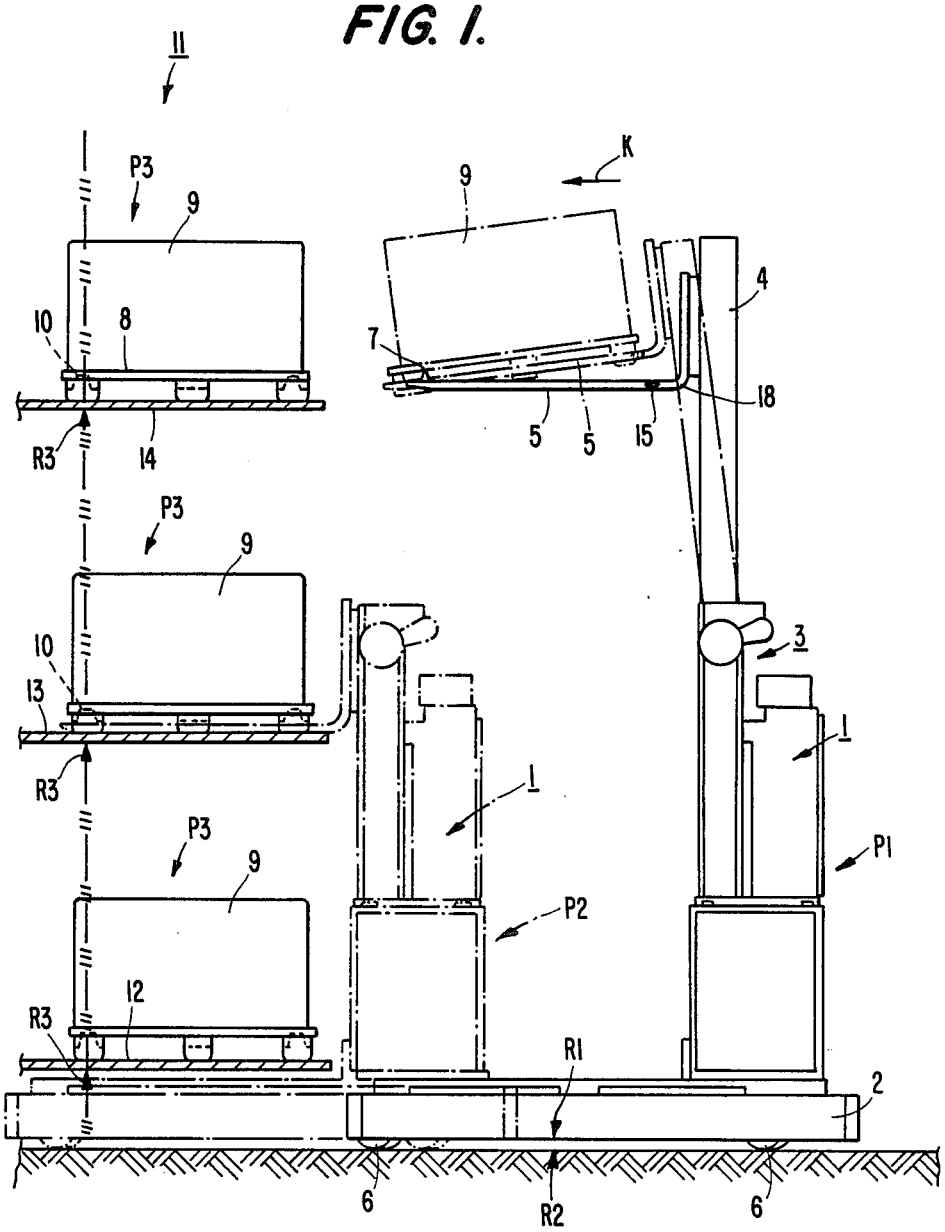
Figure 2:
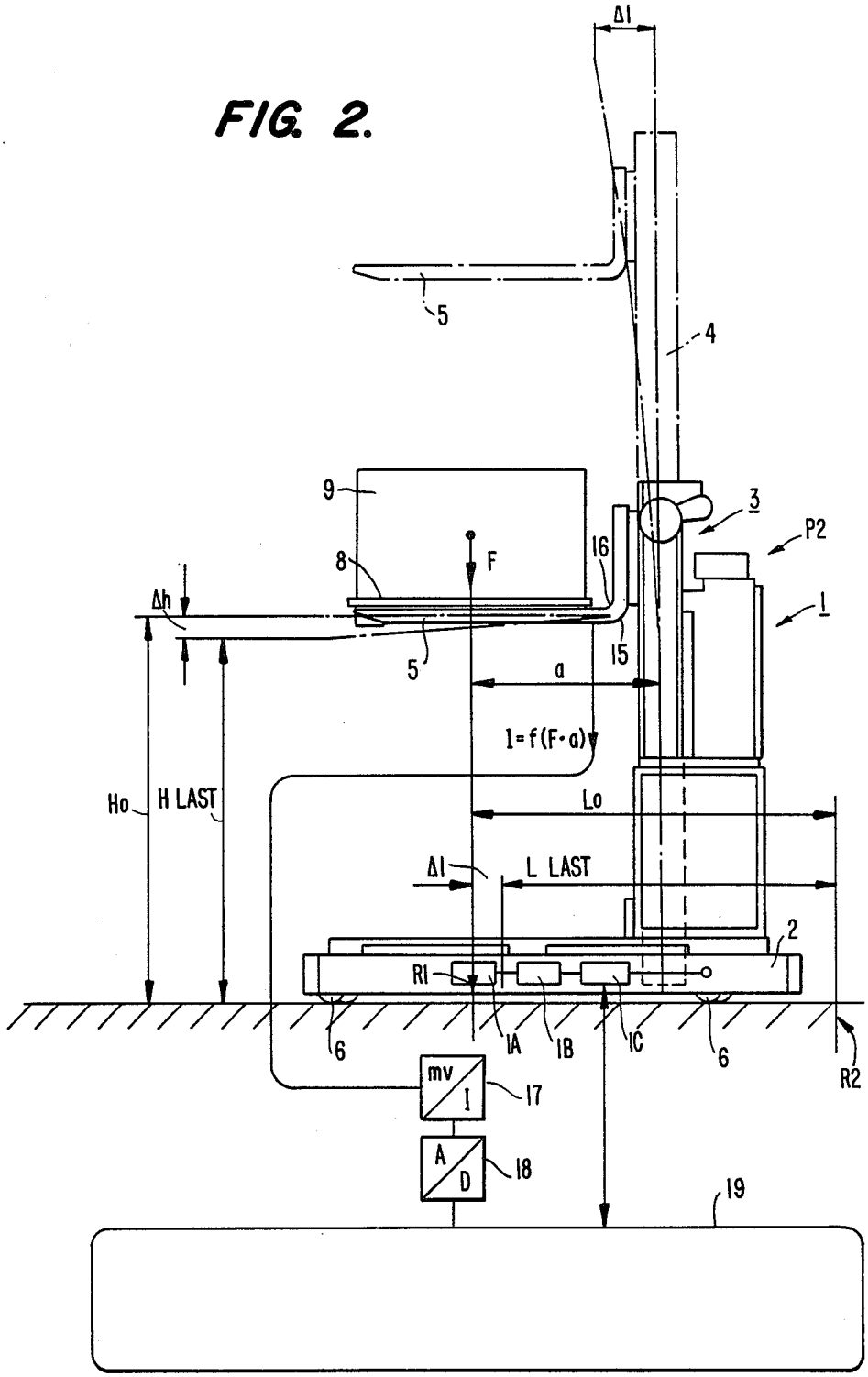

The invention will be further described below with reference to the accompanying drawings, in which FIG. 1 is a schematic side view of a vehicle close to a storage rack on which goods are to be delivered, and FIG. 2 schematically illustrates the same vehicle in a delivering position.

The vehicle 1 illustrated in the figures is a fork lift truck having a wheeled frame 2 and a lifting device 3 provided thereon which comprises a mast 4 and vertically adjustable load carrying means 5 on said mast in the form of lifting forks.

The fork lift truck is adapted to be controlled by reference markings provided on the floor and it includes a device 1A for indicating whether the truck 1 moves along the correct path of travel relative to the reference markings and whether it is correctly situated in certain positions. The values indicated by the indicating device 1A are fed into a calculating device 1B which calculates the signals received and cooperates with a control system 1C which in turn cooperates with driving units for the driving wheel 6 in such a way that the fork lift truck 1 is moved back to it correct course or position if it has departed therefrom. The driving wheels 6 are preferably of the same type and individually operable in the same manner as in the vehicle of U.S. Pat. No. 3,746,112.

Each lifting fork 5 provided with two upwardly directed pins 7 positioned beside each other and adapted to hold the load on the lifting forks 5, here loading stools or pallets 8 with goods 9. The loading stools or pallets 8 have downwardly open recesses 10 corresponding to said pins 7.

The lifting forks 5 may be set such that the load 8, 9 can be delivered and fetched in a storage system 11 at e.g. three different levels 12, 13 and 14 disposed above each other.

The fork lift truck 1 is controlled to be in a load lifting position P1 illustrated with solid lines in FIG. 1. The fork lift truck 1 is in this position P1 when a reference point R1 on its frame is situated in an exact position relative to a reference point R2 in one of the reference markings. In this position P1, the load 8, 9 shall be lifted or elevated to a height corresponding to that level 11–14 at which the load 8, 9 is to be delivered. Hereby, the lifting position P1 of the fork lift truck 1 is chosen such that it may lift the load 8, 9 without the lifting forks 5 bumping into the storage system 11. After the required elevation of the load 8, 9 relative to the storage system 11, it is intended that the fork lift truck 1 shall be operated to move a drive-up length $L_o$ from the lifting position P1 to a delivering position P2 (shown with dashed and dotted lines in FIG. 1 and with solid lines in FIG. 2), wherein it delivers the load 8, 9 in a predetermined exact delivering position P3 at each level or plane 12, 13 or 14. The drive-up length $L_o$ is set in advice to correspond with the movement of the fork lift truck 1 without load from the lifting position P1 (determined by the reference point R2) to its delivering position P2. The load 8, 9 is in exact delivering position P3 on its level 12, 13 and 14 when e.g. the recesses 10 of the loading stool or pallet 8 are situated opposite to the reference point R3 on each level 12, 13 or 14.

When the load 8, 9 affects the mast 4, said mast is deflected outwards in the direction of movement K of the fork lift truck 1 from the lifting position P1 towards the delivering position P2 and this deflection increases with the height of the elevated load 8, 9. Furthermore, the deflection of the mast 4 also increases with the weight of the load 8, 9. Because of the various deflections of the mast 4, the position of the load 8, 9 will vary relative to the frame 2, which means that the heavier the load and the higher it is lifted, the farther into the storage system 11 it will end up relative to its predetermined delivering positions P3 although the fork lift truck 1 is moved the exact drive-up length from the lifting position P1 until the frame 2 is situated in its exact delivering position P2.

In order to compensate for these deflections of the position of the load 8, 9 such that the load ends up in its exact correct delivering position P3 at each level 12, 13 and 14 respectively, irrespective of how much the mast 4 is deflected outwardly, the size $\Delta 1$ of the outward deflection of the mast is determined and the for lift truck 1 is operated to move from the reference point R2 towards the delivering position P2 a distance or length $L_{last}$ corresponding to the drive-up length set reduced with the partial length Δl. Hereby, the fork lift truck 1 can be moved the entire drive-up length Lo and thereafter back the partial length Δl, whereafter the load 8, 9 is situated in its exact delivering position P3 for disposal on the respective level or plane 12, 13, 14. Alternatively, the fork lift truck 1 may be moved a drive-up length $L_o-\Delta l$, whereby it is not necessary to move the truck backwards disposing the load 8, 9 at its exact delivering position P3.

For compensating the downward deflection Δh subjected to the lifting forks 5 when loads 8, 9 are carried thereby, this downward deflection Δh is determined and the lifting forks 5 are operated to elevate a partial height Δh if necessary such that said lifting forks get clear of each level 12, 13 and 14 respectively, when the truck 1 is moved from the lifting position P1 to the delivering position P2.

At the fork lift truck 1 shown, the outward deflection of the mast 4 and the downward deflection of the forks 5 are determined by a thread stretching indicator 15 positioned in the base 16 of the lifting fork. The thread stretching indicator 15 is adapted to measure the moment on the entire truck framing caused by the load 8, 9 on the mast as well as on the lifting forks, by measuring the mechanical stress in the fork base 16. The values determined by the thread stretching indicator 15 are fed to a signal processor 19 and the signals processed therein are fed to an analog/digit- transformer 18. The signals transformed therein are fed to a computer 19 for calculating $L_{last}$ and $H_{last}$ according to the following formulas:

$$L_{last}=L_o-\Delta l=L_o-f(F\cdot a\cdot H\cdot K_H)$$

$$H_{last}=H_o-\Delta h=H_o-f(F\cdot a)$$

whereby

Δl=outward deflection of the mast 4 when loaded

Δh=downward deflection of the forks 5 in view of the load

F=attraction of the load a=moment arm of the load $L_o$=drive-up length in delivering at load=0

$H_o$=height of fork at load=0

$H_{last}$=height of fork when loaded $L_{last}$=drive-up length in delivering position when loaded I=f(F·a) i.e. proportional to the moment caused by the load on the fork and lifting framing Δl=f(F·a·H·$K_H$) outward deflection of the framing with regard to load and height Δh=f(F·a) downward deflection of the fork is proportional to the moment in the fork base $K_H$=correction factor for outward deflection of the mast in view of height (the flexural strength of the mast is not the same with regard to the height).

The thread stretching indicator 15 comprises a unit known per se and the following equation is applicable thereon:

$$\Delta R=f(\lambda)$$

where

ΔR=change of resistance in the indicator

λ=stretch in the material.

The computer 19 is adapted to cooperate with the control system of the fork lift truck 1 such that the truck is operated to move a drive-up length $L_{last}$ in dependence of the outward deflection of the mast. The computer 19 also cooperates with a control system (not shown) in the lifting device 3 such that the forks are elevated a partial height Δh in dependence of the downward deflection thereof, if required.

By means of the method described above, loads 8, 9 may be delivered repeatedly in exact positions P3 and fetched therefrom a repeated number of times. Measuring of the outward deflection of the mast 4 may be accomplished by other types of measuring means than said indicator 15 and these means may be provided on another suitable location on the truck than the base of the fork. It is neither absolutely necessary to compensate the downward deflection of the fork, since the forks eventually may be dimensioned so heavily that this deflection is negligible. However, if compensation is required, it is advantageous to measure the downward deflection of the fork with the same means as for measuring the outward deflection of the mast. Hereby, values obtained at one point may be utlilized for two types of compensation.

Within the scope of the following claims, the method described above may be utilized for other types of vehicles than fork lift trucks and these vehicles may have other driving wheels than the above-mentioned. The load carrier may be of another type than forks and the load may consist of other goods than those carried on loading stools or pallets.

I claim:

1. A method of compensating for departures in the position of loads on a lifting device relative to a frame of a vehicle, the vehicle having control means for being controlled by reference markings on a floor and being adapted to repeatedly deliver loads on a load carrier to different levels in a storage system, said method comprising the steps of:

(a) predetermining a delivering position (P3) along an axis corresponding to each storage level;

(b) measuring with the control means on the vehicle a drive-up length (10) corresponding to a length required to move the vehicle without a load from a reference point on the floor (R2) to an unload delivering position (P2), the unload delivering position (P2) allowing a vertically adjustable load carrying means attached to a mast to deliver loads to the delivering positions (P3) on the storage levels;

(c) at a loading position (P1), loading goods on the vertically adjustable load carrying means provided on a mast of the vehicle and lifting the load carrying means on the mast to the desired vertical level;

(d) measuring stress on the load carrying means and activating a calculating means to determine outward and downward deflection of the mast under load at the desired vertical level;

(e) while maintaining the mast in the deflected position, moving the vehicle from the loading position (P1) to the reference point on the floor (R2) and using the vehicle control means, moving the vehicle from the reference position toward the unload delivering position (P2) by a length corresponding to the drive-up length (L0) reduced by an amount depending upon the outward deflection of the mast and moving the vertically adjustable load carrying means upward by an amount depending upon the downward deflection of the mast.

2. Method according to claim 1 comprising positioning the reference point (R2) at a location on a predetermined path of travel of the movement of the vehicle toward the delivering position (P2) such that the vehicle, when situated in a predetermined relationship with said reference point (R2), is in a load lifting position (P1) relative to said delivering position (P2), whereby the load carrier, which is elevated during load lifting, has clearance to the storage system for receiving the load when the vehicle is in said load lifting position (P1).

3. Method according to claim 1 further comprising determining the size of the outward deflection of the mast and of the downward deflection of the load carrier by sensing the strain of the load on those parts of the load carrier situated between load carrying members and members thereof cooperating with the mast.

4. Method according to claim 1, comprising sensing the strain of the load on the load carrier by means of a thread stretching indicator.

5. Method according to claim 1, wherein the load carrier has two lifting forks comprising sensing the strain of the load on the load carrier by means of a thread stretching indicator provided in the base of at least one of the lifting forks.

6. The method of claim 1 further comprising the steps of: moving the vehicle using the vehicle control means from the reference point on the floor (R2) an amount equal to the drive-up length (L0) and subsequently moving the vehicle in an opposite direction by an amount compensating for outward deflection of the mast.

* * * * *